United States Patent [19]

Walters et al.

[11] Patent Number: 4,520,746

[45] Date of Patent: Jun. 4, 1985

[54] FLOTATION COLLAR

[76] Inventors: William F. Walters, 103. The Street, Bramford, Ipswich Suffolk, England, 1P84DY; Kurt Lammerich, 25 Dalehead Rd., Preston, Lancashire; John D. Watney, 43 Gertrude St., London SW10, both of England

[21] Appl. No.: 453,957

[22] Filed: Dec. 28, 1982

[30] Foreign Application Priority Data

Jan. 5, 1982 [GB] United Kingdom ..... 8200099

[51] Int. Cl.[3] ..... B63B 43/10

[52] U.S. Cl. ..... 114/69; 114/123

[58] Field of Search ..... 114/360, 123, 68, 69

[56] References Cited

U.S. PATENT DOCUMENTS

| | | | |
|---|---|---|---|
| 589,133 | 8/1897 | Menzies | 114/123 |
| 3,121,888 | 2/1964 | Morgan et al. | 114/360 |
| 3,797,435 | 3/1974 | Dunson | 114/68 |
| 3,822,662 | 7/1974 | Morita et al. . | |

FOREIGN PATENT DOCUMENTS

| | | | |
|---|---|---|---|
| 141299 | 4/1920 | United Kingdom | 114/360 |

*Primary Examiner*—Jesus D. Sotelo

*Attorney, Agent, or Firm*—Wenderoth, Lind & Ponack

[57] ABSTRACT

An inflated flotation collar is formed around at least part of the hull of a boat by positioning a longitudinal inflatable member along at least part of the length of both the port and starboard sides of the hull. The terminal portions of the member are secured so that the linear length of the gunwale over which the member extends is substantially fixed and so that the member is held substantially at gunwale level on the hull by securing devices passing around and optionally over but not under the hull. The inflatable member is inflated, whereby the expansion of the member causes the member to bear against the hull against the restraining effect of the securing of the terminal portions.

9 Claims, 3 Drawing Figures

FLOTATION COLLAR

BACKGROUND OF THE INVENTION

The present invention relates to a device and method for improving the stability of a boat.

With many small boats, i.e. those with a waterline length of less than seven meters, problems are encountered with providing adequate stability to shallow draft hulls and adequate buoyancy in case the hull becomes filled with water, e.g. by capsizing or being holed. Often buoyancy is provided by internal airtight tanks or compartments. However, these occupy valuable space within the hull. It has also been proposed to form an integral buoyancy collar around the gunwale of the hull during manufacture to provide external buoyancy to the hull. However, this method is expensive and can only be applied to boats during manufacture. The large number of existing hulls can not be given this form of buoyancy.

It has been proposed to provide inflatable fenders around the hull. These can also act as buoyancy aids, but only over comparatively short lengths of the hull. Moreover, these fenders are merely suspended over the side of the boat and will therefore provide buoyancy only when the hull is partially sunk.

It has been proposed to fix a longitudinal buoyancy collar along the hull of the boat at a number of points, see U.S. Pat. No. 3,797,435. However, such a collar will drag in the water (see FIG. 3 of the U.S. patent) and will affect the handling of the boat on which it is mounted, unless it is provided with upper fixings as shown in FIG. 5 of the U.S. patent. This increases the cost of mounting the collar and, since the up-thrust of the collar is applied only at the fixings, will impose localised stresses on the hull. Also at least part of the up-thrust of the collar is applied through the lower mountings which are below the centre of gravity of the hull and will tend to exert a capsising effect on the hull, especially in cross seas.

It has also been proposed to fit an envelope around the hull of a boat to cover holes in the hull or to protect the hull. Whilst such envelopes may have an inflatable collar as an integral part thereof, that collar does not grip the hull and remains in position on the hull solely because of the envelope which encases the hull. Such envelopes are cumbersome in use and are not capable of being fitted to a wide variety of hulls.

SUMMARY OF THE INVENTION

The inventors have now devised a method of providing a flotation collar on a hull and a collar for use in such a method which reduces the above problems.

Accordingly, the present invention provides a method for forming an inflated flotation collar around at least part of the hull of a boat, which method comprises positioning a longitudinal inflatable member along at least part of the length of both the port and starboard sides of the hull; securing the terminal portions of the member so that the linear length of the gunwale over which the member extends is substantially fixed and so that the member is held substantially at gunwale level on the hull by securing means passing around and optionally over but not under the hull; and inflating the inflatable member whereby the expansion of the member causes the member to bear against the hull against the restraining effect of the securing of the terminal portions.

The invention also provides a collar for use in the method of the invention and which comprises at least one inflatable member adapted to be placed at substantially gunwale level along both the port and starboard sides of the hull of a boat and having means for passing around and optionally over but not under the hull for retaining the location of the terminal portions of the member with respect to the gunwale of the hull and having means whereby the inflatable members can be inflated so as to expand against the restraining effect of the retaining means and thus bear against the hull.

The method and flotation collar of the invention are characterised in that the inflatable member is supported at substantially gunwale level so that it grips the hull as it is inflated due to the terminal portions of the member being held so that they can not move towards one another and thus occupy a shorter gunwale length and in that they do not have envelope means passing under the hull which can affect the handling of the boat and which are cumbersome to fit. This overcomes the need for providing any anchorage points for the collar on the hull in most cases, thus enabling the collar to be used directly on a wide variety of boats. Downward movement of the collar is minimised by a simple strap or pocket extending over the gunwale of the boat and again no fixings on the hull are usually required for this. Since the up-lift of the collar acts substantially uniformly along the hull, this reduces localised stresses on the hull, notably where the gunwale is provided with a radially outward projection, e.g. a rubbing strake, which serves to prevent upward slip of the inflated collar on the hull. The collar is held at substantially gunwale level on the hull and will thus not contact the water, so that the handling characteristics of the boat will be substantially unaffected. Also, since the securing means does not extend under the hull, it does not cause an increase in the drag characteristics of the hull. If the boat is heeled over, e.g. due to poor weight distribution of load or passengers, the up-thrust of the collar will be applied at gunwale level and not below the centre of gravity, thus aiding self-righting of the boat.

BRIEF DESCRIPTION OF THE DRAWINGS

To aid understanding of the invention, it will be described with respect to a preferred form thereof as shown in the accompanying drawings in which.

DETAILED DESCRIPTION OF THE INVENTION

Figure 1:
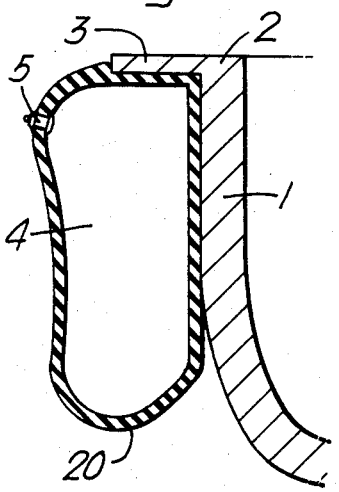
FIG. 1 is a diagrammatic vertical section through the gunwale of a boat fitted with the collar of the invention prior to inflation thereof.

A boat hull, e.g. of wood, steel, aluminium, glass fibre re-inforced plastics or other suitable material, comprises a hull wall 1 having at its upper lip a gunwale 2. The hull can be of any form of construction and preferably has a rubbing strake 3 running along the gunwale 2 from stem to stern which prevents the inflated collar of the invention from moving upwards over the gunwale. Whilst the invention can be applied to deep sheered hulls and keeled hulls, it is of especial benefit on shallow draft boats with comparatively flat bottomed hulls, since these are particularly susceptible to capsising and pooping, especially when fitted with an outboard engine.

Along the port and starboard sides of the hull are fitted buoyancy members 4. These are inflatable, e.g. by pumping air or other gas such as $CO_2$ into the member to inflate it. Inflation can be achieved by any suitable means and is usually done via a one way valve 5, which can be of any suitable design and construction. Members 4 can extend for the full gunwale length of the hull; or can extend over only part of the full length as shown in dotted lines in FIG. 3.

Members 4 can be made from a wide variety of water resistant and substantially air-tight materials, e.g. a rubber coated fabric. A particularly preferred material is a substantially inextensible one formed from a woven synthetic fibre or a reticulate polymeric sheet material, notably a woven polyester or polyalkylene fibre, coated with a polymeric material, e.g. a polyamide, a polyurethane or a vinylic polymer. Many suitable forms of material are commercially available. Member 4 can be formed with several compartments thereto so that if one section of the member should be punctured the remainder will still provide buoyancy. This can conveniently be achieved by forming bulkheads 6 within a generally tubular member 4.

Figure 2:
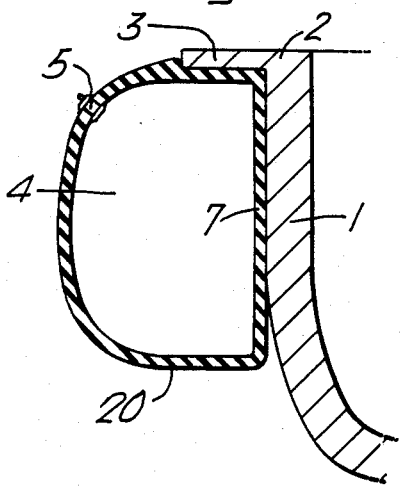
FIG. 2 is a similar view showing the collar of FIG. 1 when inflated.
Figure 3:
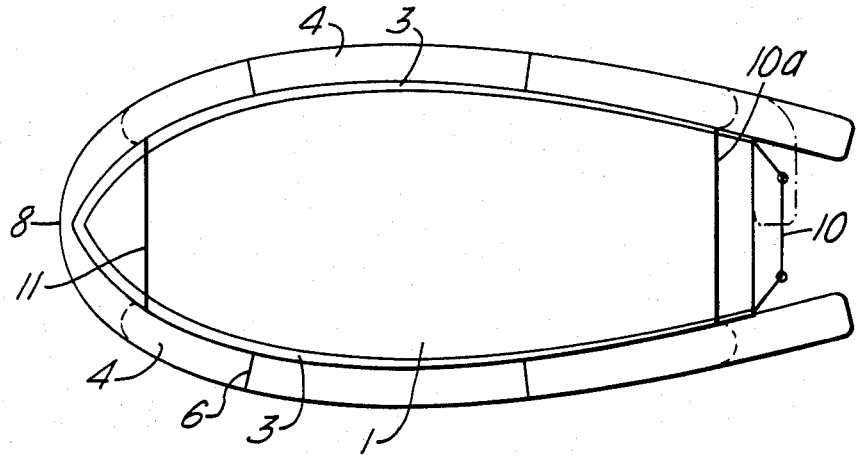
FIG. 3 is a plan view of the boat of FIG. 2.

Members 4 can have a cross-section of any suitable shape. For convenience of manufacture, this will usually be substantially circular. However, as shown in FIG. 2, members 4 can be of D section with the flat 7 of the D lying against the hull so as to improve the frictional grip of the member against the hull. Alternatively, member 4 can have a squared, triangular, hexagonal or other polygonal cross-section. Usually, member 4 will be of substantially uniform cross-section along its length. However, it may be desired to alter the cross-section of the member where it passes around the stem of the boat. For example, the walls of the member 4 can be welded together at that point to provide a flat portion 8 as shown in FIG. 3, which can be more readily wrapped around the sharp curvature of the stem than a tubular section.

The members 4 for each side of the hull can be formed as separate portions, one for the port side and one for the starboard, which are laced or otherwise attached to one another across the stem and/or stern of the boat. However, it is within the scope of the present invention to form the whole of the collar from a single inflatable member, preferably having a flatted section 8 to pass around the stem as described above. Alternatively, a shaped section of rigid pipe or other solid or hollow member can be provided to link the two Members 4 of the collar across the stem.

Members 4 desirably are of such length that they extend along the full length of the gunwale of the boat. However, where the boat is to carry an outboard motor at its stern, each member 4 can extend astern of the hull as shown in FIG. 3 to provide sponsons extending beyond the stern of the boat giving additional buoyancy to support the weight of the outboard engine. Also, by having the facility to extend the members 4 beyond the stern of the boat, it is possible to fit a number of lengths of hull with a given length of member 4. Where this is done it is preferred to provide the member 4 with a series of tying tabs as described below.

As indicated above, the collar is placed around the hull at substantially gunwale level and the terminal portions are held so that they can not move to any appreciable extent towards the bow of the boat or drop significantly below gunwale level. If they were free to move, the members 4 would not bear against the hull during inflation. In contrast to earlier proposals, we do not pass an envelope under the hull, which is cumbersome and requires that each collar be designed to fit a specific shape and size of hull. In the present invention the securing of the terminal portions is achieved by passing a strap, rope or other form of fixing 10 over or around the stern of the boat to link the sternwards ends of the members 4 together. This fixing 10 can pass over a cleat or the outboard engine bracket on the stern of the boat to prevent the members 4 from slipping down the hull. Alternatively, a second strap can be passed over the gunwale at the stern and be tied to a thwart or cleat within the boat, or member 4 can be provided with a suitable pocket into which the stern quarter of the hull fits to locate the member 4 upon the hull.

The bow ends of members 4 also require fixing to prevent the bow ends of the members moving down or sternwards upon inflation. The flatted portion 8 linking members 4 may be sufficient to hold the bow ends of the members 4 in position when the stern fixings are drawn tight.

In operation, the un-inflated collar is mounted on the hull by passing the members 4 along each side of the hull so that the stem of the boat fits into whatever means links the bow ends of the members 4. For example, with the construction shown in FIG. 3, the stem of the boat will fit against the flat portion 8 linking the bow ends of members 4 and is prevented from moving down the hull by passing strap 11 over the hull. The stern ends of the members are linked together, e.g. by tying a strap 10 to an eyelet 13 on a tab on one member, passing the strap around the stern of the boat and tying the free end of the strap through an eyelet on a tab on the end of the other member. Strap 10 can be passed over the outboard engine bracket, where this is fitted, to stop the stern ends of members 4 from stripping downwards; or a second strap **10*a* can be passed over the hull as shown. At this stage, the collar does not grip the hull along all its length and it may be desired to provide some form of means for preventing the medial regions of the members 4** from sagging downwards. This can be, for example, by means of co-operating hook and eye type fabrics as are sold under the trade Name Velcro; or by any other suitable means. Since this attachment has to support only the weight of the collar before this is inflated, the attachment means can be comparatively lightweight and will impose little or no stress on the hull.

When the collar is in position around the hull, it is inflated, e.g. using a foot or other pump or by means of a gas bottle, to the desired pressure. During inflation, the members 4 will expand. At least part of this expansion will be towards the hull and the members 4 will therefore bear against the hull and, when fully inflated, will grip the hull to locate the collar upon the hull. This will place tension on the fixing means 10, 11 linking the bow and stern ends of the members 4. If the ends of the members were free to move, as with conventional designs of fenders and the flotation collar of U.S. Pat. No. 3,797,435, the collar would not grip the hull. If desired, the fixing means can incorporate a spring or other tension release means, so that excessive tension is not applied to the ends of the members where they are over-inflated. Vertical movement of the collar on the hull is restricted by the gunwale strake 3 and by flat portion 8 and straps 10 and **10*a* securing of the ends of members 4**.

With most shapes of hull, the inflated members 4 will bear against the hull over substantially all of their length. However, with long hulls which have comparatively little curvature in the gunwale from stem to stern, the members 4 may bow away from the hull in places. This bow may be sufficient for the member 4 to be able to ride over the rubbing strake 3 at the gunwale. It may therefore be necessary in those cases to provide simple anchorage means, e.g. straps 20, to hold the member 4 against the hull at those points. Also, the inner and/or outer face of members 4 can be provided with reinforcement, e.g. extra layers of material, to minimise wear of member 4 against the hull or a jetty or the like; and they can be given a roughened surface to improve the grip of the member on the hull.

The method and collar of the invention provide a simple means for improving the stability and buoyancy at gunwale level of a wide range of boats for which no other means are readily available. Since the collar can be readily removed after use, it does not affect the ability of the boat owner to transport his boat on a trailer or car roof. Also, since little or no modification of the hull of the boat is needed for use of the collar, specifically it is not necessary to mount fixings through the hull as with other proposals, the collar of the invention can be used with a wide range of sizes and shapes of hull.

We claim:

1. A method for forming an inflated flotation collar around at least part of the hull of a boat having a radially outwardly extending projection along the gunwale of said hull, said method comprising:

positioning at least one longitudinal inflatable member of a generally tubular construction and made from a substantially inextensible material along at least part of the external length of both the port and starboard sides of said hull and below said radial projection;

securing directly together the terminal portions of said member against movement towards one another so that the linear length of said gunwale over which said member extends is substantially fixed by securing means separate from said hull and passing around the end surfaces of the stem and stern of the hull but not under said hull; and inflating said inflatable member, whereby the expansion of said member causes said member to bear against said hull against the restraining effect of the securing of said terminal portions so that said member is held substantially at gunwale level on said hull.

2. A method as claimed in claim 1, further comprising passing additional securing means over said hull for securing together said terminal portions of said members.

3. A method as claimed in claim 1, comprising connecting together the bow-wards terminal portions of two said inflatable members, one lying to each side of said hull, by means which pass around the stem of said hull and which substantially prevent separation of said terminal portions.

4. A method as claimed in claim 1, comprising connecting together the stern-wards terminal portions of two said inflatable members, one lying to each side of said hull, by means which are passed across the transom of said hull.

5. A method as claimed in claim 1, wherein the stern-wards ends of said inflatable member are provided with a series of longitudinally spaced positions at which said securing means can be attached to said member, and attaching said securing means to said member at selected different points depending upon the length of the hull on which said member is mounted.

6. A flotation collar for mounting at substantially gunwale level upon a boat hull having a radially outwardly extending projection along the gunwale thereof and for inflation with a gas so as to provide buoyancy to the hull, said collar comprising:

at least one inflatable generally tubular member made from a substantially inextensible material and adapted to be placed at substantially gunwale level along both the port and starboard side of a hull and below the radially extending projection;

securing means separate from the hull for passing around the end surfaces of the stem and stern of the hull but not under the hull for retaining the location of the terminal portions of said members with respect to the gunwale of the hull and for securing directly together said terminal portions against movement towards one another; and means for enabling said member to be inflated so as to expand radially against the restraining effect of said retaining means and thus bear against the hull so as to secure said flotation collar substantially at gunwale level on the hull.

7. A collar as claimed in claim 6, further comprising additional securing means passing over said hull for securing together said terminal portions of said hull.

8. A collar as claimed in claim 6, wherein said securing means comprises a flat portion linking first ends of two said members and adapted to pass around the stem of the hull and substantially to prevent separation of said first ends of said members, and at least one strap linking second ends of said members and passing across the transom of the hull.

9. A boat hull having secured thereto a collar as claimed in claim 6, wherein said collar is secured to the hull at least partially by means of the gripping action caused by inflation of said collar.

* * * * *